US005313669A

United States Patent [19]

Rasdell et al.

[11] Patent Number: 5,313,669

[45] Date of Patent: May 24, 1994

[54] CLOTHING ANCHOR APPARATUS

[76] Inventors: Mornez Rasdell; Thelma Rasdell, both of 868 Cypress Ave., Elkins Park, Pa. 19117

[21] Appl. No.: 16,559

[22] Filed: Feb. 11, 1993

[51] Int. Cl.[5] ..... A41F 1/00

[52] U.S. Cl. ..... 2/323; 2/107; 2/112; 2/117; 2/338; 2/247; 24/301; 24/302

[58] Field of Search ..... 2/107, 112, 117, 145, 2/240, 268, 260, 323, 325, 304, 306, 340, 338, 333, 335, 247, 248, 249, 250, 251, 252; 24/170, 301, 302, 465, 474, 475, 519, 520; 450/86

[56] References Cited

U.S. PATENT DOCUMENTS

| | | | |
|---|---|---|---|
| 211,479 | 1/1879 | Shelby | 2/335 |
| 746,194 | 12/1903 | Storey | 2/306 |
| 1,023,538 | 4/1912 | White | 2/323 |
| 1,782,057 | 11/1930 | Bollinger | 24/301 |
| 2,070,016 | 2/1937 | Lipton | 2/335 |
| 2,089,869 | 8/1937 | Wratschko | 24/519 |
| 2,363,872 | 11/1944 | Kiessling | 24/170 |
| 3,521,798 | 7/1970 | Hill | 2/338 X |
| 4,575,874 | 3/1986 | Johnson | 2/268 |
| 4,835,821 | 6/1989 | Durante | 24/49 CF |
| 5,177,813 | 1/1993 | Bosack et al. | 2/333 X |

*Primary Examiner*—Clifford D. Crowder

*Assistant Examiner*—Jeanette E. Chapman

*Attorney, Agent, or Firm*—S. Michael Bender

[57] ABSTRACT

A new and improved clothing anchor apparatus, especially useful for anchoring the front and back tails of shirts, includes a first clothing connector, a second clothing connector, and an elastic strap connected therebetween. The elastic strap has a first end, an interior portion, and a second end. A strap length adjuster is located on the interior portion of the strap for adjusting the effective length of the strap. The effective length of the strap is adjusted by adjustingly doubling a portion of the strap. A soft, flexible jacket encompasses a portion of the elastic strap and the strap length adjuster. The jacket may also include a pocket for receiving and secretly storing soft, flexible items such as paper money. In use, preferably, two clothing anchor apparatuses of the invention are used. One clothing connector of each apparatus is attached to the front shirt tail, and the other clothing connector of each apparatus is attached to the back shirt tail by first passing under the crotch area. The soft, flexible jacket provides comfortable contact with the crotch area. The apparatuses of the invention serve to pull the shirt tails downwardly, giving the shirt a neat appearance and preventing the shirt tails from becoming untucked from pants that are worn.

7 Claims, 4 Drawing Sheets

CLOTHING ANCHOR APPARATUS

BACKGROUND OF THE INVENTION

1. Field of the Invention

The present invention relates generally to clothing anchors and money retainers, and more particularly, to a clothing anchor especially adapted to retain money in a secret location.

2. Description of the Prior Art

Clothing anchors are well known in the art. More specifically, the following U.S. Pat. Nos. disclose devices designed to hold down shirt tails: 4,074,364 of Lucero; 4,596,569 of Campbell; 4,853,979 of Ryder; and 4,937,886 of Ellis. All of devices in the above-mentioned patent soperate in a similar way. Two pairs of clips (or other connectors) are located on the four ends of two straps. Two connectors are connected to the front shirt tail, the straps are passed between the legs and under the crotch, and the other two connectors are connected to the rear shirt tail. The straps are elastic so that there is an inherent and limited degree of adjustability due to the elasticity of the straps. Yet, with these devices, there does not seem to be a provision for adjusting the lengths of the straps beyond the inherent elasticity of the straps. Such a limitation is undesirable in view of the fact that people come in all shapes and sizes, and the inherent elasticity of elastic straps may not be enough to accommodate many different shapes and sizes of users. Moreover, it is noted that the elements of the above-mentioned devices that pass under the crotch areas do not seem to be especially soft or comfort-providing. This lack of soft material is an undesirable feature of the prior art devices considering the sensitive nature of the crotch area.

Also well known in the art are devices, attached to clothing, for storing items. For example, U.S. Pat. No. 4,771,515 of Guarro discloses an eyeglass holder placed in a shirt pocket.

It is also well known for people to secret money in their shoes and in money belts. What is not disclosed in the prior art is a shirt anchor, a portion of which that passes under the crotch, that has a provision for storing items, such as paper money, in secret.

The foregoing disadvantages in the prior art are overcome by the unique clothing anchor apparatus of the present invention as will be made apparent from the following description thereof. Other advantages of the present invention over the prior art also will be rendered evident.

SUMMARY OF THE INVENTION

To achieve the foregoing and other advantages, the present invention briefly described, provides a new and improved clothing anchor apparatus, especially useful for anchoring the front and back tails of shirts. The apparatus of the invention includes a first clothing connector, a second clothing connector, and an elastic strap connected therebetween. The elastic strap has a first end, an interior portion, and a second end. A strap length adjuster is located on the interior portion of the strap for adjusting the effective length of the strap. The effective length of the strap is adjusted by adjustingly doubling a portion of the strap. A soft, flexible jacket encompasses a portion of the elastic strap and the strap length adjuster. The jacket may also include a pocket for receiving and secretly storing soft, flexible items such as paper money. In use, preferably, two clothing anchor apparatuses of the invention are used. One clothing connector of each apparatus is attached to the front shirt tail; and the other clothing connector of each apparatus is attached to the back shirt tail by first passing under the crotch area of the wearer. The soft, flexible jacket provides comfortable contact with the crotch area. The apparatuses of the invention serve to pull the shirt tails downwardly, giving the shirt a neat appearance and preventing the shirt tails from becoming untucked from pants that are worn.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved clothing anchor apparatus which has all of the advantages of the prior art and none of the disadvantages.

It is another object of the present invention to provide a new and improved clothing anchor apparatus which may be easily and efficiently manufactured and marketed.

It is a further object of the present invention to provide a new and improved clothing anchor apparatus which is of durable and reliable construction.

An even further object of the present invention is to provide a new and improved clothing anchor apparatus which is susceptible of a low cost of manufacture with regard to both materials and labor, and which accordingly is then susceptible of low prices of sale to the consuming public, thereby making such clothing anchor apparatus available to the buying public.

Still yet a further object of the present invention is to provide a new and improved clothing anchor apparatus which includes a provision for adjusting the lengths of the straps beyond the inherent elasticity of the straps.

Yet a further object of the present invention is to provide a new and improved clothing anchor apparatus that has a portion that passes under the crotch area and that is especially soft or comfort-providing.

Yet another object of the present invention is to provide a new and improved clothing anchor apparatus which includes a portion which passes under the crotch and that has a provision for storing items, such as paper money, in secret.

These together with still other objects of the invention, along with the various features of novelty which characterize the invention, are pointed out with particularity in the claims annexed to and form a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

With reference to the drawings, a new and improved clothing anchor apparatus embodying the principles and concepts of the present invention will be described.

Figure 1:
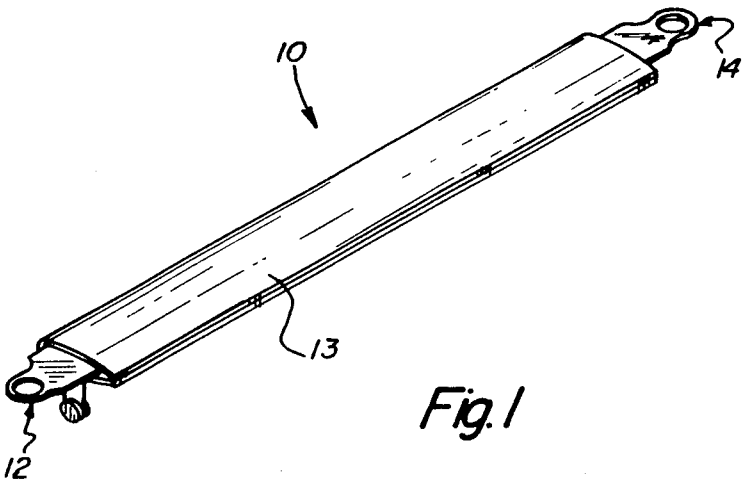
FIG. 1 is a perspective view showing a first preferred embodiment of the clothing anchor apparatus of the invention.

Turning initially to FIG. 1, there is shown a first exemplary embodiment of the clothing anchor apparatus of the invention generally designated by reference numeral 10. In its preferred form, clothing anchor apparatus 10 includes a first clothing connector 12, a second clothing connector 14, and an elastic strap 16 (see FIG. 2) connected to both the first clothing connector 12 and the second clothing connector 14.

Figure 2:
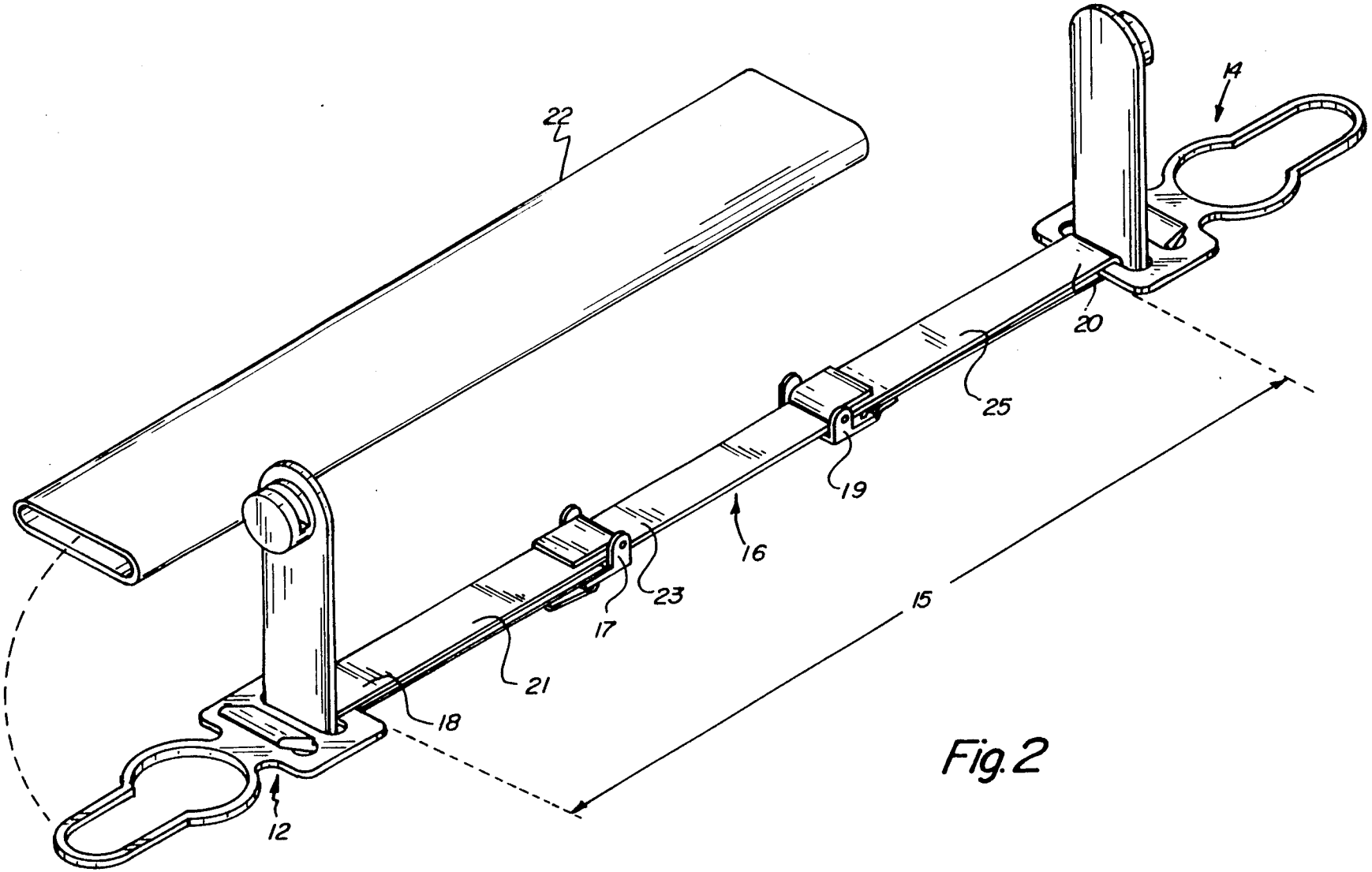
FIG. 2 is an enlarged, partially exploded, perspective view of a second embodiment of the clothing anchor apparatus the invention.
Figure 3:
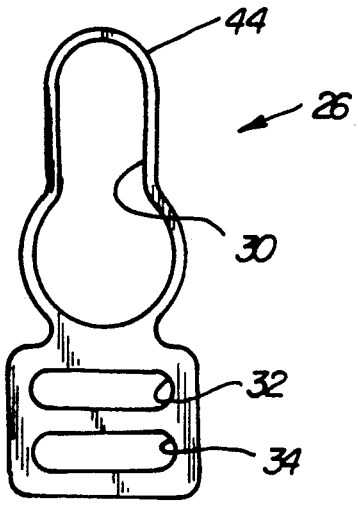
FIG. 3 is an elevational view of a female member of a clothing connector used in the embodiment of the clothing anchor apparatus of the invention shown in FIG. 2.
Figure 4:
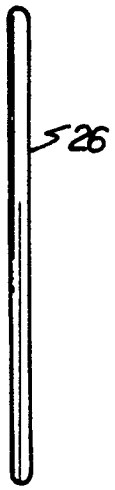
FIG. 4 is side view of the female member of the clothing connector shown in FIG. 3.
Figure 5:
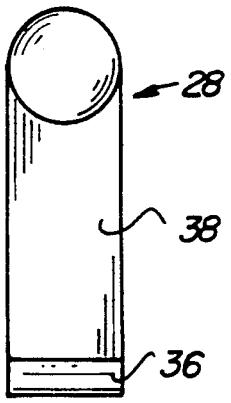
FIG. 5 is an elevational view of the male member of a clothing connector used in the clothing anchor apparatus of the invention shown in FIG. 2.
Figure 6:
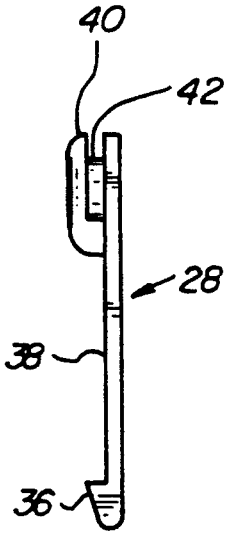
FIG. 6 is a side view of the male member of the clothing connector shown in FIG. 5.

Turning to FIG. 2, a second embodiment of the clothing anchor apparatus 10 of the invention is shown. This embodiment also includes a first clothing connector 12, a second clothing connector 14, and an elastic strap 16 connected to both the first clothing connector 12 and the second clothing connector 14. More specifically, the strap 16 has a first end 18, an adjustable effective length 15, and a second end 20. Also, the strap 16 includes a first portion 21, a second portion 23, and a third portion 25. Means for adjusting the length of the strap 16, first and second strap adjusters 17 and 19, respectively, are connected to the strap 16, for adjusting the effective length 15 of the strap 16. A clear benefit of the elastic nature of the strap 16 is that the elastic stretches with body movements such as bending and lifting.

More specifically, the first strap portion 21 is doubled up and is connected to the first clothing connector 12 and to the first strap adjuster 17. The first strap adjuster 17 is used to adjust the extent of strap doubling present in strap portion 21. The second strap portion 23 is connected between the first strap adjuster 17 and the second strap adjuster 19. The third strap portion 25 is doubled up and is connected between the second strap adjuster 19 and the second clothing connector 14. The second strap adjuster 19 is used to adjust the extent of strap doubling present in strap portion 25.

Adjustment the strap doubling by strap adjusters 17 and 19 serves to adjust the effective length 15 of the strap 16. More specifically, when first strap adjuster 17 is unlocked and moved in the direction of the second clothing connector 14, the first clothing connector 12 is pulled toward the second clothing connector 14; and the bottom portion of the first strap portion 21 is pulled under the single second strap portion 23, whereby the doubled up first strap portion 21 is enlarged and the second strap portion 23 is diminished. However, since the first strap portion 21 is doubled up, and the second strap portion 23 is single, the reduction in the length of the second strap portion 23 would be twice the increase in the length of the first strap portion 21. Thus, the net result of adjusting the strap 16 in this way is to decrease the effective length 15 of the strap 16. Conversely, the effective length 15 of the strap 16 can be increased by moving the first strap adjuster 17 in the opposite direction.

Similarly, when the second strap adjuster 19 is unlocked and moved in the direction of the first clothing connector 12, the second clothing connector 14 is pulled toward the first clothing connector 12; and the bottom portion of the third strap portion 25 is pulled under the single second strap portion 23, whereby the doubled up third strap portion 25 is enlarged and the second strap portion 23 is diminshed. However since the third strap portion 25 is doubled up, and the second strap portion 23 is single, the reduction in the length of the second strap portion 23 would be twice the increase in the length of the third strap portion 25. Thus, the net result of adjusting the strap 16 in this way is to decrease the effective length 15 of the strap 16. Conversely, the effective length 15 of the strap 16 can be increased by moving the second strap adjuster 19 in the opposite direction.

Soft, flexible jacket 22 is used to jacket the elastic strap 16 and the strap adjusters 17 and 19. The jacket 22 can be tubular piece of soft, flexible cloth, such as washable terry cloth, and can be slipped over the strap 16 from either the first clothing connector 12 end (as shown in FIG. 2) or the second clothing connector 14 end. The soft jacket 22 prevents the wearer of the clothing anchor apparatus 10 of the invention from being caused discomfort in the crotch area by the strap 16 and the strap adjusters 17 and 19.

As shown in greater detail in FIGS. 3–6, the first and second clothing connectors 12 and 14 are each comprised of a female connector member 26 and a male connector member 28. Each female connector member has three slots: a large, two-diameter latching slot 30 and two smaller, parallel, narrow slots 32 and 34. As shown in FIG. 2, the doubled up first strap portion 21 is looped around the second narrow slot 34. The first narrow slot 32 receives a hook end 36 of the male connector member 28.

In addition to the hook end 36, the male connector member 28 also includes a mid-portion 38 and a grooved latch 40. The groove 42 in the latch 40 is received by the upper rim 44 of the female connector member 26 when a piece of cloth material, such as cloth from a shirt tail, is placed over the female connector member 26 before the grooved latch 40 of the male connector member 28 is latched onto the upper rim 44 of the female connector member 26.

Figure 7:
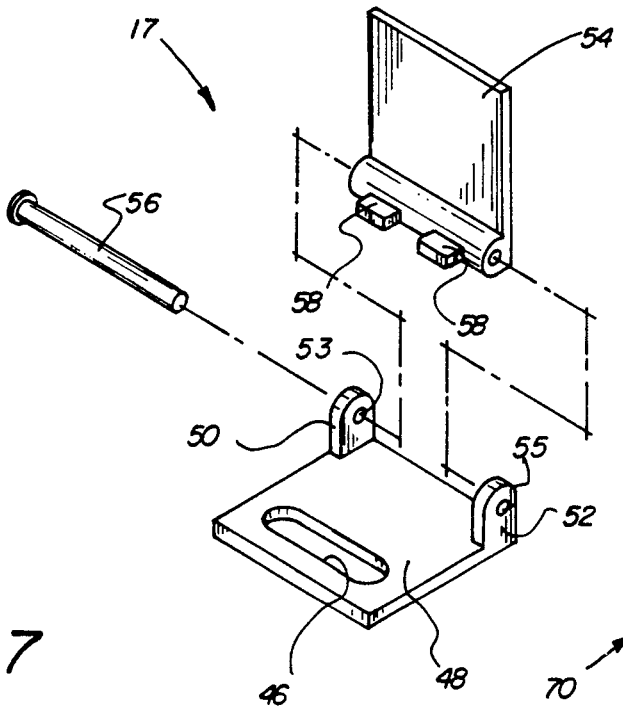
FIG. 7 is an exploded perspective view of a strap adjuster shown in the clothing anchor apparatus of the invention shown in FIG. 2.

Turning to FIG. 7, the first strap adjuster 17 is shown in greater detail. An extreme end of the strap 16 is looped through slot 46 is a base portion 48 of the first strap adjuster 17. Extending up from the base portion 48 are two struts 50 and 52. The struts 50 and 52 include holes 53 and 55, respectively, which are spaced above the base portion 48, providing a clearance which permits a single flat portion of the strap 16 to pass through the clearance. A top locking member 54 is connected to the struts 50 and 52 by a hinge pin 56. Lock blocks 58 project from the bottom of the top locking member 54. In use, a single flat portion of the strap 16 passes through the clearance provided by the holes 53 and 55 on the struts 50 and 52. When the effective length 15 of the strap 16 is to be adjusted, the top locking member 54 is moved into the vertically extending orientation shown in FIG. 8. In this orientation, the lock blocks 58 are out of engagement with the strap 16. However, once the desired effective length 15 of the strap 16 is obtained, the locking member 54 is swung around the hinge pin 56, permitting the lock blocks 58 to engage with and secure the strap 16 from moving out of adjustment.

Figure 8:
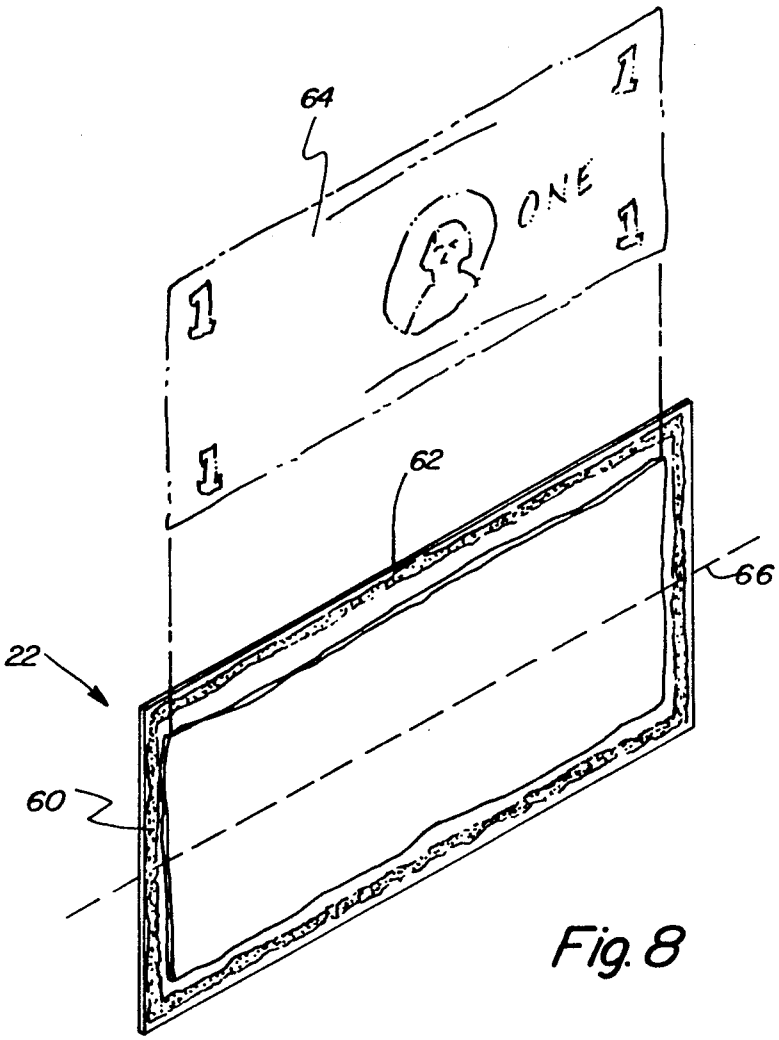
FIG. 8 is a perspective view of a jacket-forming material for the embodiment of the clothing anchor apparatus of the invention shown in FIG. 1, wherein the material may receive paper money for retention in the jacket after the jacket is formed, the jacket being formed by folding the jacket-forming material in half, over itself, with the elastic strap and the strap adjusters of the invention and the paper money sandwiched between the folded over jacket-forming material.

Turning to FIG. 8, the jacket 13 shown in FIG. 1 is shown in greater detail. In this embodiment, the jacket 13 is formed from a flat, soft, flexible material 60 that is framed with a border 62 containing a thin film of a contact adhesive. The framed region of the material 60 is large enough to include a thin, flexible item, such a paper money 64. Once the money is positioned within the framed border 62, the material 60, with the paper money 64 within the framed region, the material 60 and paper money 64 are wrapped around the strap 16 by folding the material 60 along the bisector line 66 shown in FIG. 9. In this way, as the material 60 and paper money 64 are wrapped around the strap 16, portions of contact adhesive in the border 62 above the bisector line 66 come into contact with portions of the contact adhesive in the border 62 below the bisector line 66, permitting the jacket 13 shown in FIG. 1 to be formed. The jacket 13 contains a pocket defined by the contact adhesive border 62 which retains the paper money 64 therein. Alternatively, instead of a contact adhesive providing the border 62, a hook and loop material can be used. That is above the bisector line 66, the hook material could be sewn; and below the bisector line 66 the loop material could be sewn. When the jacket 13 is formed by folding over the bisector line 66, the hook and loop material will engage one another and provide a revesible bond.

Figure 9:
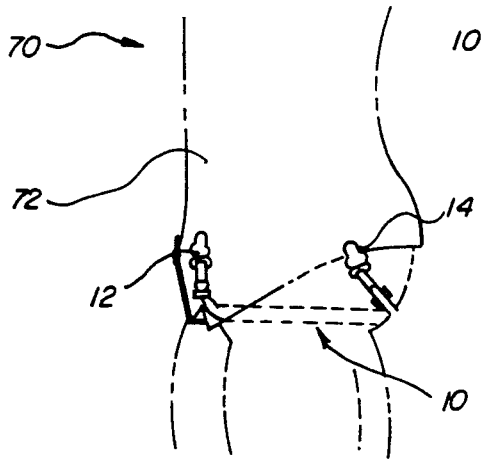
FIG. 9 is a schematic side view of a person wearing two clothing anchor apparatuses of the invention to anchor a shirt by its shirt tails.

In FIG. 9, an embodiment of the clothing anchor apparatus 10 of the invention is shown being worn by a wearer 70 and connected to the left side of a shirt 72. The first clothing connector 12 is connected to the left front shirt tail, and the second clothing connector 14 is connected to the left back shirt tail. The strap, associated strap adjusters, and the jacket are positioned under the wearer's crotch.

Figure 10:
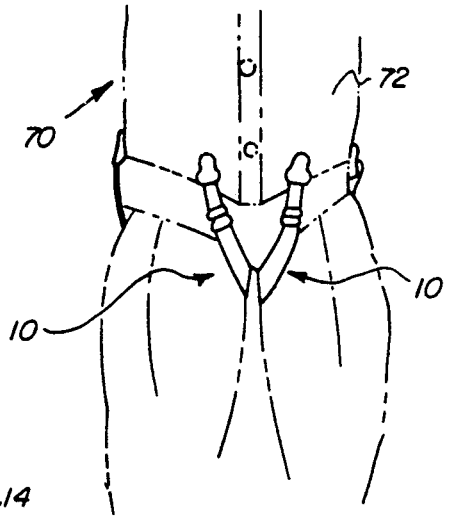
FIG. 10 is a schematic front view of a person wearing two clothing anchor apparatuses of the invention to anchor a shirt by its shirt tails.

In FIG. 10, two embodiments of the clothing anchor apparatus 10 of the invention are being worn by the wearer 70. One of the clothing anchor apparatus 10 is connected to the left side of the shirt 72, front and back sides; and the other clothing anchor apparatus 10 is connected to the right side of the shirt 72, front and back sides.

If desired, the clothing anchor apparatus 10 of the invention can be provided in a range of sizes such as small, medium, and large. The elastic strap 16 can be made from conventional elastic materials such as are conventionally used in clothing materials having elastic components.

It is apparent from the above that the present invention accomplishes all of the objects set forth by providing a new and improved clothing anchor apparatus that is low in cost, relatively simple in design and operation, and which may advantageously be used to anchor shirts and the like and secretly store paper money.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved clothing anchor apparatus, comprising:

a first clothing connector;

an elastic strap connected to said first clothing connector, said strap having a first end, an adjustable effective length, and a second end;

means, connected to said strap, for adjusting the effective length of said strap, wherein said strap adjusting means includes means, placed between said first end and said second end of said strap, for adjustingly doubling a portion of said strap;

a second clothing connector connected to said second end of said strap; and soft, flexible jacket means for jacketing a portion of said elastic strap and covering said strap length adjusting means, said jacket means comprising a tubular sleeve having first and second opposed ends defining first and second openings, said tubular sleeve having a length between said first and second openings sufficient to extend between said first and second clothing connectors when said strap is slidably received through said first and second openings of said jacket to cover said means for adjusting said strap.

2. The apparatus described in claim 1 wherein the clothing that is anchored is a shirt.

3. The apparatus described in claim 1 wherein:

said elastic strap is comprised of a first portion, a second portion, and a third portion;

said means for adjusting the effective strap length is comprised of a first adjustment means and a second adjustment means;

said first strap portion is connected to said first clothing connector;

said first adjustment means is connected to said first strap portion;

said second strap portion is connected to said first adjustment means;

said second adjustment means is connected to said second strap portion;

said third strap portion is connected to said second adjustment means;

said second clothing connector is connected to said third strap portion;

said soft, flexible jacket means jackets a portion of said first strap portion, said first adjustment means, said second strap portion, said second adjustment means, and a portion of said third strap portion.

4. The apparatus described in claim 1 wherein said jacket means includes a pocket for receiving items.

5. The apparatus described in claim 4 wherein the items received by said pocket include paper money.

6. The apparatus described in claim 1 wherein said tubular sleeve comprises a flexible sheet member having a pocket for receiving items therein, said sheet member further having attachment means extending along a border thereof whereby said member may be folded about a bisector line and attached to itself by said attachment means to dorm said tubular sleeve.

7. The apparatus of claim 6 wherein said pocket is sized to receive paper money therein.

* * * * *